US006582322B2

(12) United States Patent
Long et al.

(10) Patent No.: US 6,582,322 B2
(45) Date of Patent: Jun. 24, 2003

(54) GOLF CLUB HEAD WITH MULTI-RADIUS FACE

(75) Inventors: D. Clayton Long, Carlsbad, CA (US); G. Thomas Mase, East Lansing, MI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/242,426

(22) Filed: Sep. 13, 2002

(65) Prior Publication Data

US 2003/0013544 A1 Jan. 16, 2003

Related U.S. Application Data

(62) Division of application No. 09/721,670, filed on Nov. 27, 2000, now Pat. No. 6,454,664.

(51) Int. Cl.[7] ..... A63B 53/04

(52) U.S. Cl. ..... 473/330; 473/345; 473/409

(58) Field of Search ..... 473/324, 345, 473/346, 342, 349, 350, 330, 331, 288, 290, 291, 409

(56) References Cited

U.S. PATENT DOCUMENTS

| | | | |
|---|---|---|---|
| 1,299,014 | A | 4/1919 | O'Hara |
| 1,525,137 | A | 2/1925 | Lawton |
| 1,615,038 | A | 1/1927 | Reuter, Jr. |
| 1,674,173 | A | 6/1928 | Haupt |
| 2,023,885 | A | 12/1935 | Hinckley |
| 2,395,837 | A | 3/1946 | Baymiller et al. |
| 3,172,667 | A | 3/1965 | Baker et al. |
| 3,625,518 | A | 12/1971 | Solheim |
| 3,989,257 | A | 11/1976 | Barr |
| 4,162,074 | A | 7/1979 | Thomson |
| 4,367,878 | A | 1/1983 | Schmidt |
| 4,471,961 | A | 9/1984 | Masghati et al. |
| 4,508,349 | A | 4/1985 | Gebauer et al. |
| 4,521,022 | A | 6/1985 | Schmidt |
| 4,725,062 | A | 2/1988 | Kinney, III |
| 5,098,103 | A | 3/1992 | MacKeil |
| 5,303,923 | A | 4/1994 | Garcia |
| 5,310,185 | A | 5/1994 | Viollaz |
| 5,333,862 | A | 8/1994 | Teramoto et al. |
| 5,333,873 | A | 8/1994 | Burke |
| 5,366,223 | A | 11/1994 | Werner et al. |
| 5,377,986 | A | 1/1995 | Viollaz |
| 5,382,019 | A | 1/1995 | Sneed |
| 5,415,405 | A | 5/1995 | Vincent |
| 5,527,034 | A | 6/1996 | Ashcraft et al. |
| 5,645,495 | A | 7/1997 | Saso |
| 5,681,228 | A | 10/1997 | Mikame et al. |
| 5,916,043 | A | 6/1999 | Saso |
| 6,093,115 | A | 7/2000 | Murtland et al. |
| 6,139,445 | A | 10/2000 | Werner |
| 2002/0002084 | A1 | 1/2002 | Miyamoto |

FOREIGN PATENT DOCUMENTS

| | | |
|---|---|---|
| JP | 9-168613 | 6/1997 |
| JP | 2880109 | 1/1999 |
| JP | 11042301 | 2/1999 |

*Primary Examiner*—Sebastiano Passaniti
(74) *Attorney, Agent, or Firm*—Swidler Berlin Shereff Friedman, LLP

(57) ABSTRACT

A metal wood golf club head adapted for attachment to a shaft is disclosed, including a shell defining an inner cavity and further including a face. The face of the club head has at least two roll radii disposed adjacent each other and defined about an alignment line on the face that extends from the heel end to the toe end. The roll radius above the alignment line is smaller than the roll radius below the alignment line. The face may also include multiple bulge radii.

7 Claims, 2 Drawing Sheets

GOLF CLUB HEAD WITH MULTI-RADIUS FACE

This application is a division of U.S. patent application Ser. No. 09/721,670 filed on Nov. 27, 2000, now U.S. Pat. No. 6,454,664, which is incorporated herein by reference in its entirety.

FIELD OF THE INVENTION

The invention relates to a golf club head. More particularly, the invention is related to a golf club head with a multi-radius face.

BACKGROUND OF THE INVENTION

The design of club heads has long been studied. Among the more prominent considerations in club head design are loft, lie, face angle, horizontal face bulge, vertical face roll, face progression, sole curvature, center of gravity location, and overall head weight. Although all of these aspects may be considered in golf club engineering, several are often accorded more weight in the design process due to their significant impact on club performance.

The shape and sizing of a club face is quite complex. Of particular interest in club head design are two characteristics of the face, the horizontal face bulge and the vertical face roll. Horizontal face bulge radius is measured from the heel to toe or along the horizontal plane of the face, and is important because it compensates for a golfer's hitting of the ball off of the centerline of the face. If a ball is hit at an off-center location, the bulge effectively compensates for this misalignment that would otherwise cause hooking or slicing. A typical wood has a horizontal face bulge radius of between 8 and 16 inches.

Vertical face roll radius is measured from the top of the face to the bottom of the face in a vertical position, and this factor affects the trajectory of the ball off the face. A typical wood has a vertical face roll radius of between 12 and 18 inches.

The presence of bulge and roll radius, and the degree of radius applied to the face, are critical to the performance of the club. As perfection in the golf swing is not attained by most golfers, off-center hits are common. Yet, proper club head design, particularly with respect to the face geometry, can help compensate for the imperfect swing. There are trade-offs, however, in setting the face geometry. Too much horizontal face bulge, for example, can lead to poor directional control. In addition, club heads having too much vertical face roll can detrimentally exacerbate the trajectory of the ball upon impact.

Typically, golf clubs are designed with a single bulge. However, some club heads have been designed with multiple bulge radii. U.S. Pat. No. 6,093,115 discloses a golf club head having an asymmetric ball striking face such that one side of the face, as measured from the center of the face, has a first bulge radius and the other side of the face has a second bulge radius. One of the heel portion and the toe portion of the ball striking face has a bulge radius of 8 inches, while the other has a bulge radius of 24 inches. U.S. Pat. No. 5,415,405 discloses a hitting surface of a golf club head that is divided into three adjacent portions, each portion forming an arc of a circle with a different radius. The radii of the various portions range between 7 and 20 inches.

Japanese Publication 11042301 discloses a golf club head with three different bulge radii. The central part of the club face has a bulge radius that is greater than that of either adjacent part, with the difference in bulge radii ranging from about 1.27 to 2.95 inches.

Golf clubs are also typically designed with a single roll radius. However, some club heads have been contemplated to include multiple roll radii. For example, U.S. Pat. No. 4,162,074 discloses a putter with a face that forms a convex striking surface. The surface is generally parabolic or exponential, and thus does not have a constant roll radius.

Moreover, U.S. Pat. No. 4,508,349 discloses a golf club with a striking face that has a central portion with accentuated roll. The central roll portion has a radius of curvature between 0.70 and 1 inch. Grooves extend parallel to the accentuated roll portion on opposite sides thereof, while flat surfaces extend along the striking face above and below the upper and lower grooves respectively. The design is claimed to provide for increased compression of the golf ball resulting in an unexpectedly long drive.

Despite the several aforementioned club head designs, there remains a need for a wood-type golf club with a club face designed to optimize launch conditions for various ball impact locations on the face. In particular, there remains a need for a golf club face with dual roll radii. Such a golf club design allows for improvement in performance such that ball launch conditions degrade less as the impact point of the ball departs from the center of the club face. In addition, there remains a need for a golf club face combining multiple bulge radii with multiple roll radii.

SUMMARY OF THE INVENTION

The present invention relates to a metal wood golf club head adapted for attachment to a shaft. The head includes a shell defining an inner cavity and further including a face. The face has at least two roll radii disposed adjacent each other and defined about a horizontal line proximate the center of the face, with a first roll radius above the line and a second roll radius below the line. Preferably, the first roll radius is smaller than the second roll radius. The first roll radius may be less than about seventy percent of the second roll radius. The first roll radius may be between about 4 inches and about 12 inches, and the second roll radius may be between about 8 inches and about 16 inches. In a preferred embodiment, the first roll radius is about 6 inches, and the second roll radius is about 10 inches.

The present invention also relates to a metal wood golf club head adapted for attachment to a shaft, including a shell defining an inner cavity and further including a face. The face has at least two roll radii disposed adjacent each other and defined about an alignment line on the face that extends from the heel end to the toe end. Preferably, a first roll radius above the alignment line is smaller than a second roll radius below the alignment line. A first roll radius above the alignment line may be less than about seventy percent of a second roll radius below the alignment line.

In another embodiment of a metal wood golf club head, the face has at least two roll radii and at least two bulge radii. The roll radii are disposed adjacent each other and defined about an alignment line on the face extending from the heel end to the toe end. Preferably, the face includes a first roll radius above the alignment line and a second roll radius below the alignment line, with the first roll radius being smaller than the second roll radius.

The present invention further relates to a metal wood golf club head adapted for attachment to a shaft. The head includes a shell defining an inner cavity and further including a face. The face has vertical and horizontal center lines proximate its center. The face also has a toe-side alignment line parallel to the vertical center line and disposed about half-way between a toe region of the shell and the vertical alignment line, and a heel-side alignment line parallel to the vertical center line and disposed about half-way between a heel region of the shell and the vertical alignment line. The face has a central region with a first bulge radius between the toe-side and heel-side alignment lines, and peripheral regions adjacent the central region. The first bulge radius of the central region of the face is substantially larger than the bulge radius of the peripheral regions of the face. In one embodiment, the bulge radius of the peripheral regions of the face is about 10% to about 40% smaller than the first bulge radius.

In addition, the present invention relates to a method of forming a metal wood golf club head, comprising the steps of: forming a shell defining an inner cavity and further including a face having a horizontal center line that extends from a heel end to a toe end, the horizontal center line defining an upper portion and a lower portion, and forming the upper portion of the face with a roll radius that is smaller than a roll radius of the lower portion of the face. The method may further include the step of forming substantially the entire upper portion of the face with a first roll radius, and forming substantially the entire lower portion of the face with a second roll radius. The face additionally may be formed with at least two bulge radii disposed about a vertical center line that extends from a crown region to a sole region, the vertical center line defining a proximal portion having a first bulge radius and a distal portion having a second bulge radius.

DETAILED DESCRIPTION OF THE PREFERRED EMBODIMENT

Figure 1:
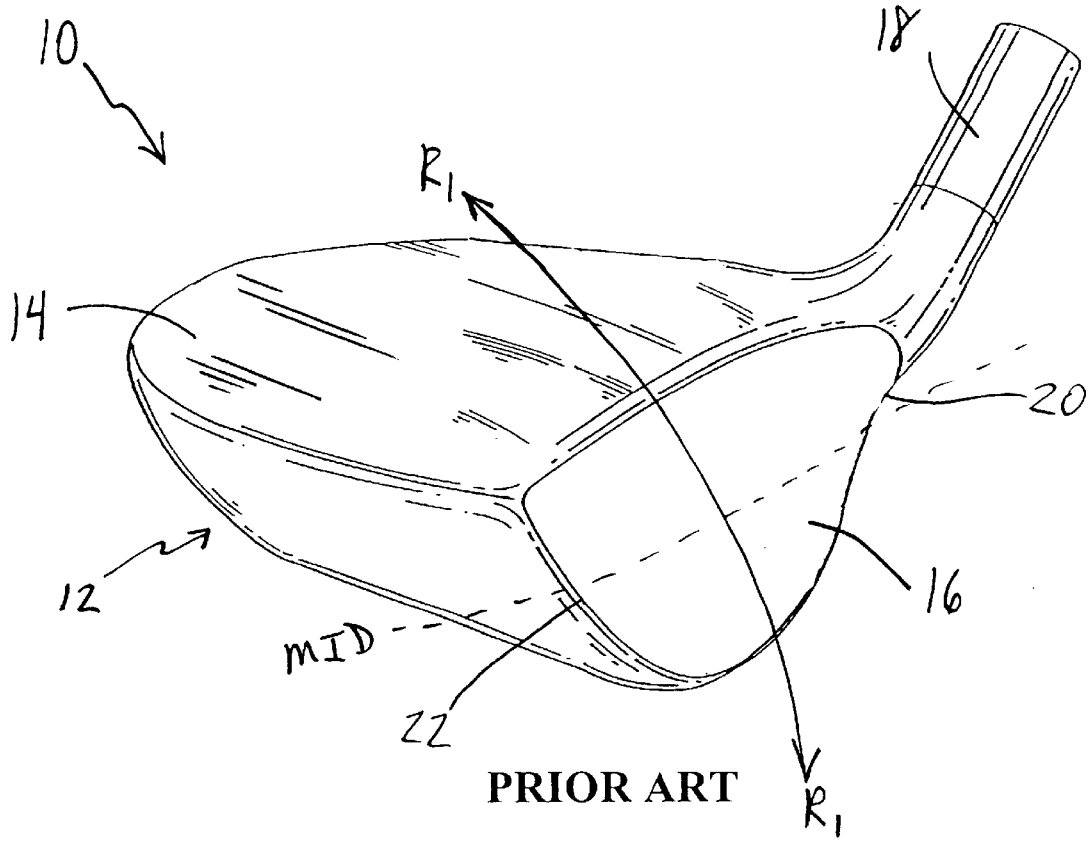
PRIOR ART Fig. 1
FIG. 1 shows a perspective view of a golf club head with a face having a single roll radius.

Referring to FIG. 1, wood-type club 10 includes a head 12 with a body 14 and a face 16, along with a shaft 18. Head 12 has a heel end 20 and a toe end 22. Although not shown in detail, club 10 may include a hosel, crown plate, and/or sole plate. The head is preferably formed of metal such as titanium and alloys thereof, and may be formed from separate body and face portions that are integrated, such as by welding. If such a multi-piece head is used, preferably the face is forged or stamped, while the body is cast. Alternatively, the face and body may both be cast as a single unit, providing for separate crown and/or sole pieces, or the club head may be only formed from forged or stamped components. Grooves may also be provided on the face.

As shown in FIG. 1, a typical wood includes a face with a single roll radius $R_1$. Such a club may, for example, be a number 1 wood, with a face nominally having a roll radius of about 10 inches.

Figure 2:
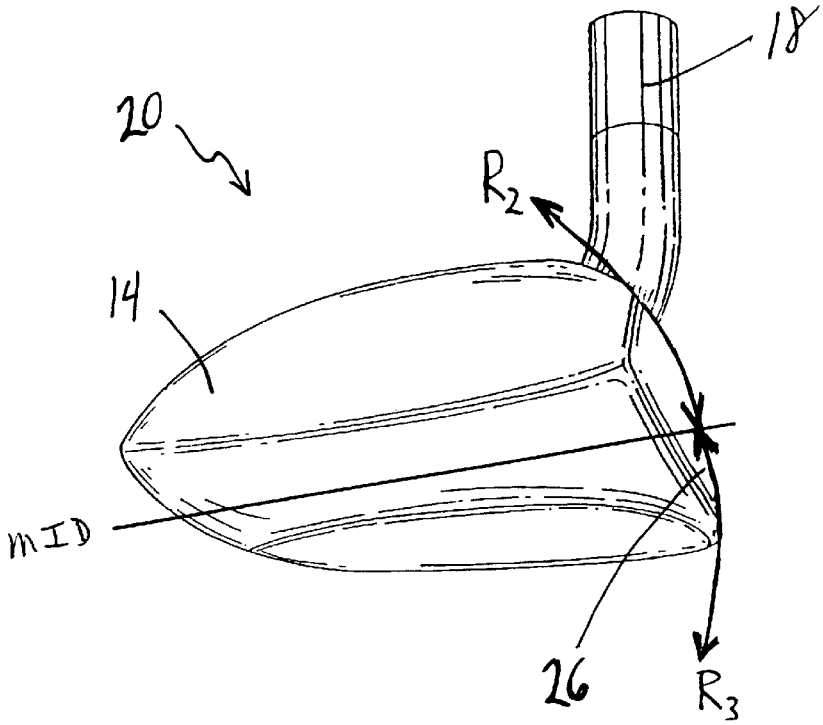
FIG. 2 shows a side view of a golf club head constructed according to the present invention with a face having multiple roll radii.

In the preferred embodiment of the present invention, a wood-type club is provided with a face having multiple roll radii. As shown in FIG. 2, wood-type club 20 has a face 26 with two different roll radii $R_2$ and $R_3$. Preferably, the change between the roll radii occurs substantially at the center of the face at mid-line MID, which is located approximately halfway between the uppermost and lowermost points of the face and extends from the heel region 20 to the toe region 22. Preferably, a smaller roll radius is chosen above line MID than below line MID. More preferably, above line MID, a relatively smaller radius between 4 and 12 inches is selected, while below line MID, a relatively larger radius between 8 and 16 inches is selected. In an alternate embodiment, the change between radii may occur along an alignment line that is not centered on the face, yet extends from the heel end to the toe end.

Advantageously, the selection of different roll radii above and below the face mid-line MID can impact the quality of a golfer's shot. The quality of the shot is predicated on several ball launch parameters, including initial velocity, backspin, and launch angle. Geometrically, the center point of the club face may be defined as the point on the face at which a line projected through the center of gravity perpendicular to the face intersects the face. Impacts above the center point result in a degraded ball backspin, and thus it is desirable to launch the ball higher so that maximum ball carry may be achieved. In the alternative, when a ball is struck below the center point of the face, the smaller roll radius tends to launch the ball too low, resulting in degraded ball flight performance. As a result, it is preferable to have a larger roll radius below the face center than above it.

EXAMPLES

These and other aspects of the present invention may be more fully understood with reference to the following non-limiting examples, which are merely illustrative of embodiments of the present invention golf club head, and are not to be construed as limiting the invention, the scope of which is defined by the appended claims.

The test results enumerated in Tables 1–3 were generated using computational techniques, which included finite element analysis models. In particular, the general purpose, explicit finite element program LS-DYNA was employed. When computer modeling the exemplary club heads, the following fixed parameters were used: a mass of 200 g, a center of gravity located 2.11 inches behind the center of the ball with the center of the face aligned along this line, a loft of 11 degrees, static and dynamic friction of 0.3, and a head speed of 109 mph. In addition, fixed heel-toe, droop, and vertical gear axis inertia terms were selected. The finite element models were used to predict ball launch conditions and a trajectory model was used to predict distance and landing area. Thus, the modeling allows a determination of the variation in launch angle, backspin, and carry distance as a function of roll and relative vertical impact position on the club face.

Club heads with Comparative Club Faces "A," "B," and "C" are configured and dimensioned with roll radii of 6 inches, 10 inches, and 14 inches, respectively. For purposes of comparison, the performance of Comparative Club Faces "A"–"C" has been normalized with respect to golf balls impacting Comparative Club Face "B" at the center of the club face. Thus, the normalized value of the ball launch angle for a golf ball hitting Comparative Club Face "B" at the face center is 1.00.

TABLE 1

TEST RESULTS FOR BALL LAUNCH ANGLE

| Relative Impact Position on Club Face (inches) | Ball Launch Angle with Comparative Club Face "A" $R_A$ = 6 inches | Ball Launch Angle with Comparative Club Face "B" $R_B$ = 10 inches | Ball Launch Angle with Comparative Club Face "C" $R_C$ = 14 inches |
|---|---|---|---|
| +0.25 | 1.376 | 1.290 | 1.247 |
| 0.00 (Face Center) | 1.032 | 1.000 | 0.978 |
| −0.25 | 0.667 | 0.688 | 0.699 |
| −0.50 | 0.312 | 0.387 | 0.419 |

As shown in Table 1, when club head performance is measured as a function of golf ball launch angle, a similar trend is generally found for each Comparative Club Face. In particular, for a given roll radius, as the golf ball impact position on the club face increases, the launch angle increases. More specifically, for example, a golf ball hit at a location 0.25 inch above the center of Comparative Club Face "B" launched at approximately a 29% higher angle than a ball hit at the center of club face. In contrast, a ball hit at locations 0.25 inch and 0.50 inch below the center of Comparative Club Face "B" launched at approximately 31% and 61% lower angles respectively than a ball hit at the center of the club face.

TABLE 2

TEST RESULTS FOR BALL BACKSPIN

| Relative Impact Position on Club Face (inches) | Ball Backspin with Comparative Club Face "A" $R_A$ = 6 inches | Ball Backspin with Comparative Club Face "B" $R_B$ = 10 inches | Ball Backspin with Comparative Club Face "C" $R_C$ = 14 inches |
|---|---|---|---|
| +0.25 | 0.79 | 0.63 | 0.55 |
| 0.00 (Face Center) | 1.06 | 1.00 | 0.97 |
| −0.25 | 1.35 | 1.39 | 1.41 |
| −0.50 | 1.61 | 1.74 | 1.79 |

Although it is generally preferable to increase the launch angle of a golf ball, the quality of an impact must be evaluated using additional criteria. For example, aerodynamics dictates that the carry distance of a golf ball is a function of the ball's backspin, launch angle, and initial velocity. As shown in Table 2, for a club face having a given roll radius, as the golf ball impact position on the club face increases, backspin decreases. For example, a golf ball hit at a location 0.25 inch above the center of Comparative Club Face "B" had approximately a 37% lower backspin than a ball hit at the center of the club face. Balls hit at locations 0.25 inch and 0.50 inch below the center of the Comparative Club Face "B," however, had increased backspins of approximately 39% and 74% respectively over a ball hit at the center of the club face.

TABLE 3

TEST RESULTS FOR BALL CARRY DISTANCE

| Relative Impact Position on Club Face (inches) | Ball Carry Distance with Comparative Club Face "A" $R_A$ = 6 inches | Ball Carry Distance with Comparative Club Face "B" $R_B$ = 10 inches | Ball Carry Distance with Comparative Club Face "C" $R_C$ = 14 inches |
|---|---|---|---|
| +20.25 | 0.993 | 0.989 | 0.978 |
| 0.00 (Face Center) | 1.004 | 1.000 | 1.000 |
| −0.25 | 0.989 | 0.986 | 0.986 |
| −0.50 | 0.932 | 0.939 | 0.939 |

In addition, as shown in Table 3, for a club face having a given roll radius, impacting a golf ball at locations away from the center of the club face results in a decrease in carry distance. For example, a golf ball hit at a location 0.25 inch above the center of Comparative Club Face "B" had approximately a 1% decrease in carry distance as compared to a ball hit at the center of the club face. Golf balls hit at locations 0.25 inch and 0.50 inch below the center of the club face had a decrease in carry distance of approximately 1.5% and 6%, respectively.

Referring to Tables 1–3, an examination of the performance of Comparative Club Face "A" (with a roll radius of 6 inches) and Comparative Club Face "C" (with a roll radius of 14 inches) demonstrates that for ball hits occurring at the same locations above the center of the club faces, the club face with the smaller roll radius launches a golf ball at a higher ball launch angle, a higher backspin, and a longer carry distance. With regard to hits occurring below the center of the club faces, however, the club face with the smaller roll radius launches a golf ball at a lower launch angle and a lower backspin.

Based on the variations in performance of club heads with Comparative Club Faces "A"–"C," the configuration of an inventive club head may be chosen. Preferably, the roll radius above the center of an inventive club head face is selected to be about 4 to 12 inches, while below the center of the face, the roll radius is selected to be about 8 to 16 inches, such that the roll radius above the center is smaller than the roll radius below it. More preferably, the roll radius above the center of an inventive club head face is selected to be about 5 to 7 inches, while below the center of the face, the roll radius is selected to be about 9 to 11 inches. Thus, an inventive club head face may have a 6 inch roll radius above the face center and a 10 inch roll radius below the face center. As previously demonstrated with respect to Comparative Club Faces "A"–"C," a ball impacting such an inventive club head face at a location 0.25 inch above the center point has an improved performance of approximately a 37.6% increase in launch angle, while experiencing only a 21% decrease in backspin. The overall carry of the ball is reduced by only 0.7%, as compared to 1.1% for a face with a 10 inch roll radius, and as a result there is a recovery of about 36% of the carry distance lost by striking the ball above the face center. In addition, the dual roll face addresses the problem encountered when a ball is hit below the face center point. The larger the roll radius used below the center of the face, the less the degradation of launch angle. Although backspin continues to be a factor affecting the overall performance of the golf shot, a larger roll radius above the center point improves the distance on below face center impacts.

As mentioned previously, a number 1 wood typically has a face with a roll radius of about 10 inches. The inventive club face of the present invention maintains this "normal" roll radius below the face center point, but has a lower roll radius above the face center point.

Golf club heads designed in accordance with the present development may alternatively include more that two roll radii. As the trends in performance have shown that a lower roll radius is desirable above the face center point, a graduated decrease in the roll radius may be chosen across the face in this region. For example, above the face center point, a roll radius of 8 inches may transition to a roll radius of 6 inches. This permits additional tailoring of the club head performance.

Figure 3:
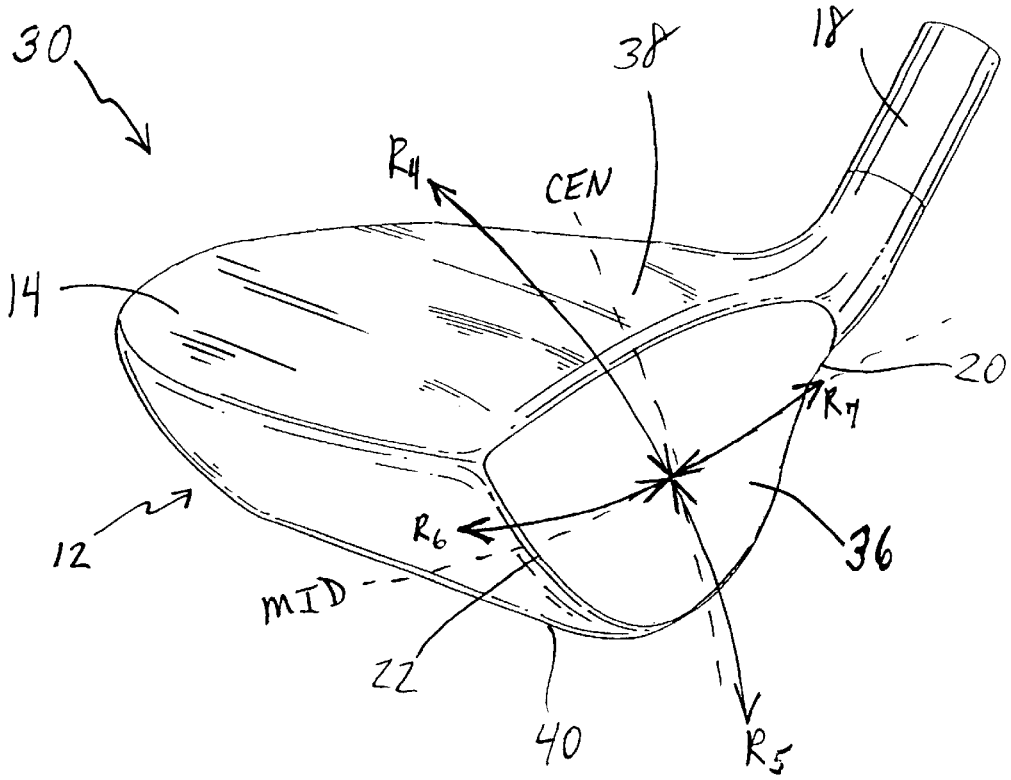
FIG. 3 shows a perspective view of another golf club head constructed according to the present invention with a face having multiple roll radii and multiple bulge radii.

The present development also is directed to a golf club face combining multiple roll radii with multiple bulge radii. As shown in FIG. 3, wood-type club 30 has a face 36 with two different roll radii $R_4$ and $R_5$ and two different bulge radii $R_6$ and $R_7$. Preferably, the change between the roll radii occurs substantially at the center of the face at horizontal mid-line MID, and a smaller roll radius is chosen above line MID than below line MID. Preferably, the change between the bulge radii occurs substantially at the center of face 36 at central line CEN, which extends vertically from crown region 38 to sole region 40. In an alternate embodiment, the change between roll radii may occur along an alignment line that is not centered on the face, yet extends from the heel end to the toe end. While variations in the bulge radii across the face can improve the directional control of golf shots, faces that also have multiple roll radii can provide improved performance such as improved ball launch angles. More than two roll radii and more than two bulge radii may also be provided in other embodiments.

Figure 4:
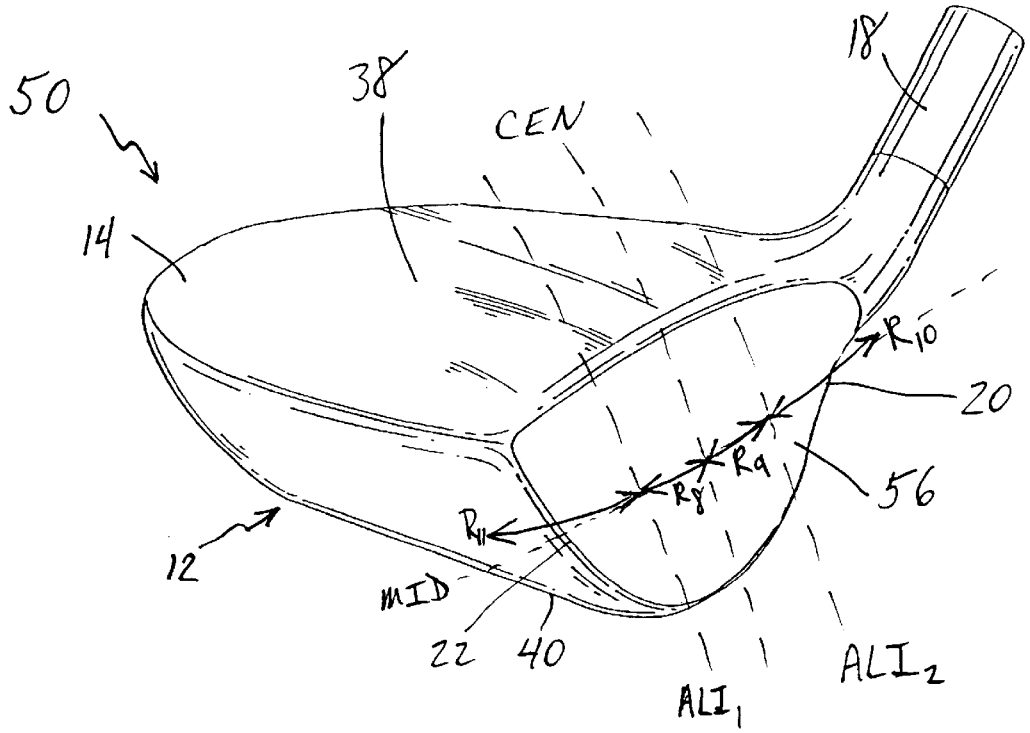
FIG. 4 shows a perspective view of another golf club head constructed according to the present invention with a face having multiple bulge radii.

In addition, the present development is directed to a golf club face combining multiple bulge radii. As shown in FIG. 4, wood-type club 50 has a face 56 with four bulge radii $R_8$, $R_9$, $R_{10}$ and $R_{11}$ Alignment line $ALI_1$ is disposed about halfway between vertical central line CEN and toe region 22 at horizontal mid-line MID, while alignment line $ALI_2$ is disposed about halfway between central line CEN and heel region 20 at horizontal mid-line MID. Preferably, bulge radius $R_8$ is bounded by lines CEN and $ALI_1$ and bulge radius $R_9$ is bounded by lines CEN and $ALI_2$. In a preferred embodiment, bulge radii $R_8$ and $R_9$ are substantially the same, while bulge radii $R_{10}$ and $R_{11}$ are substantially the same and are substantially smaller than bulge radii $R_8$ and $R_9$ In a more preferred embodiment, bulge radii $R_8$ and $R_9$ are substantially the same, while bulge radii $R_{10}$ and $R_{11}$ are each about 10% to 40% smaller than bulge radii $R_8$ and $R_9$. Face 56 may have a single roll radius, or multiple roll radii, for example, as described herein with respect to other embodiments of the present invention. In one embodiment, the roll radius above horizontal mid-line MID is smaller than the roll radius below it.

While various descriptions of the present invention are described above, it should be understood that the various features of each embodiment can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A method of forming a metal wood golf club head, comprising the steps of:

forming a shell defining an inner cavity and further including a face having a horizontal center line that extends from a heel end to a toe end, the horizontal center line defining an upper portion and a lower portion;

forming the upper portion of the face with a roll radius that is smaller than a roll radius of the lower portion of the face; and forming the lower portion of the face with a roll radius between about 8 inches and 16 inches;

wherein the step of forming the upper portion includes forming the upper portion of the face with a roll radius that is less than about seventy percent of the roll radius of the lower portion of the face.

2. The method of claim 1, further comprising the step of forming substantially the entire upper portion of the face with a first roll radius, and forming substantially the entire lower portion of the face with a second roll radius.

3. The method of claim 2, wherein the face is additionally formed with at least two bulge radii disposed about a vertical center line that extends from a crown region to a sole region, the vertical center line defining a first portion having a first bulge radius and a second portion having a second bulge radius.

4. The method of claim 3, wherein:

the face is additionally formed with a first alignment line substantially parallel to and biased toward a first side of the vertical center line and a second alignment line substantially parallel to and biased toward a second side of the vertical center line;

the first alignment line, the vertical center line, and the second alignment line divide the face into four portions; and each of the four portions has a bulge radius.

5. The method of claim 4, wherein:

the four portions include two central portions toward the center of the face and two outer portions toward the heel end and toe end of the face, respectively;

the bulge radii of the central portions are substantially the same; and the bulge radii of the outer portions are substantially the same and less than the bulge radii of the central portions.

6. The method of claim 5, wherein the bulge radii of the outer portions are approximately about 10% to 40% smaller than the bulge radii of the central portions.

7. The method of claim 1, wherein the roll radius of the upper portion of the face is between about 4 inches and about 12 inches.

* * * * *